United States Patent [19]

Brunn

[11] Patent Number: 4,807,926

[45] Date of Patent: Feb. 28, 1989

[54] FOLDING FURNITURE

[76] Inventor: Oswald Brunn, Bunzlauer Platz 1, Munich 50, Fed. Rep. of Germany

[21] Appl. No.: 108,194

[22] Filed: Oct. 13, 1987

[30] Foreign Application Priority Data

Oct. 14, 1986 [DE] Fed. Rep. of Germany ..... 3635003

[51] Int. Cl.[4] ..... A47C 3/02

[52] U.S. Cl. ..... 297/33; 297/131; 297/258; 297/272

[58] Field of Search ..... 297/131, 132, 133, 258, 297/272, 33

[56] References Cited

U.S. PATENT DOCUMENTS 2,715,937 8/1955 Thomas ..... 297/258 X 3,114,572 12/1963 Hopkins ..... 297/133 X 3,269,771 8/1966 Erdos ..... 297/132

FOREIGN PATENT DOCUMENTS 963088 12/1949 France ..... 297/33

*Primary Examiner*—James T. McCall

*Attorney, Agent, or Firm*—Townsend & Townsend

[57] ABSTRACT

Folding furniture, in particular folding chair, which can be converted to a rocking chair by a rocker pair attachable to the front legs and rear legs. The rockers are formed such that they are articulately connected to the one leg pair while between each rocker and the other leg pair a relative movement can be carried out to bring the folding furniture, together with the rockers, into a compact collapsed form.

7 Claims, 3 Drawing Sheets

FOLDING FURNITURE

The invention relates to folding furniture.

The invention relates to folding furniture, in particular to folding furniture with adjustable backrest and/or seat as described in particular in German patent application No. P 36 07 619.

The invention is based on the problem of providing folding furniture of the type which can be adapted in function to a rocking chair and in this function as well can be folded up to a very compact space.

According to the invention folding furniture, in particular folding chair with a backrest and a seat, comprises guide elements arranged in the region of connecting pieces between backrest and seat and cooperating with a guide in or on the rear legs, wherein front leg and rear leg are respectively in connection with a rocker and each rocker includes extending at least over a portion of the length thereof a guide groove along which the lower end of the legs of one of the leg pairs is displaceable.

Further developments are set forth in the subsidiary claims.

The invention relates to folding furniture, in particular a folding chair which by attaching rockers or runners can be use as rocking chair or rocking armchair and retains the facility originally given to it of adjusting the seat inclination and/or backrest inclination and at the same time when not in use can be folded up together with the rockers or runners and due to its compactness needs very little storage space. In addition, the rockers can be attached and removed in extremely simple manner. At least one of the cross struts to be provided between the two rockers can be inserted at various positions, thus increasing the comfort depending upon the size of the person using the chair or armchair. A particular advantage is that due to the specific formation of the rockers the armchair can be easily brought by applying a minimum of force into the completely collapsed state with the rockers attached and just as easily out of the collapsed state into the fully extended state.

Figure 1:
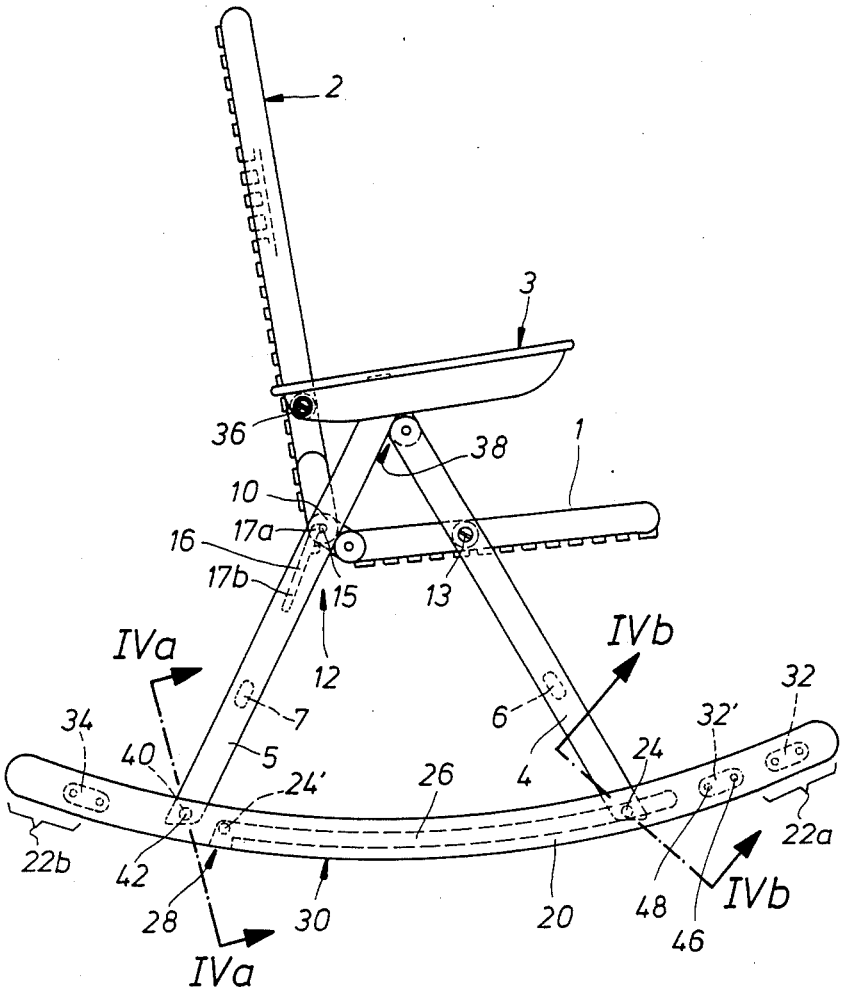
Figure 2:
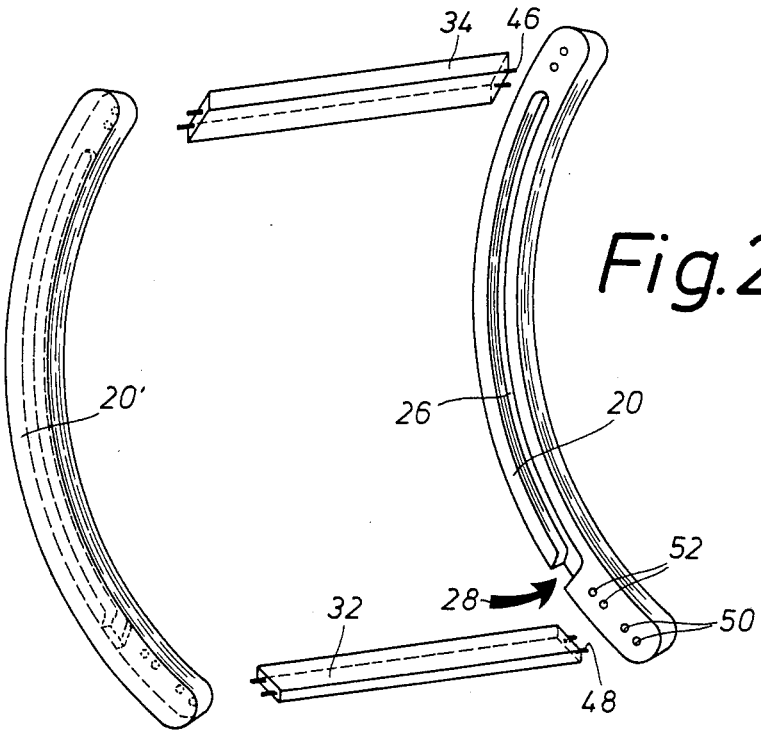
Figure 4A:
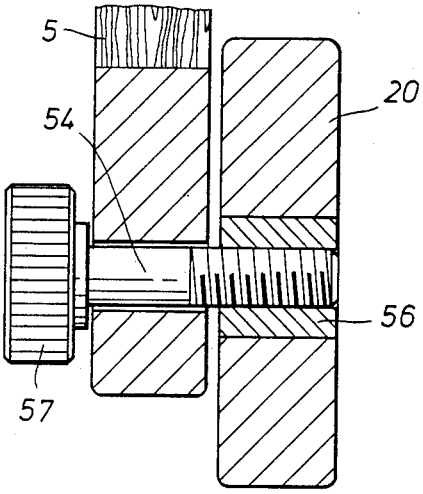
Figure 4B:
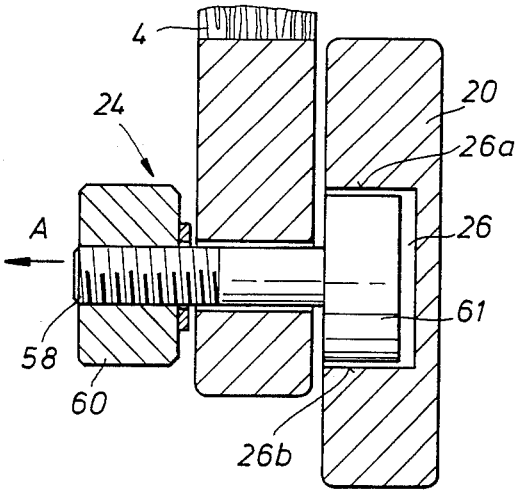
Figure 3:
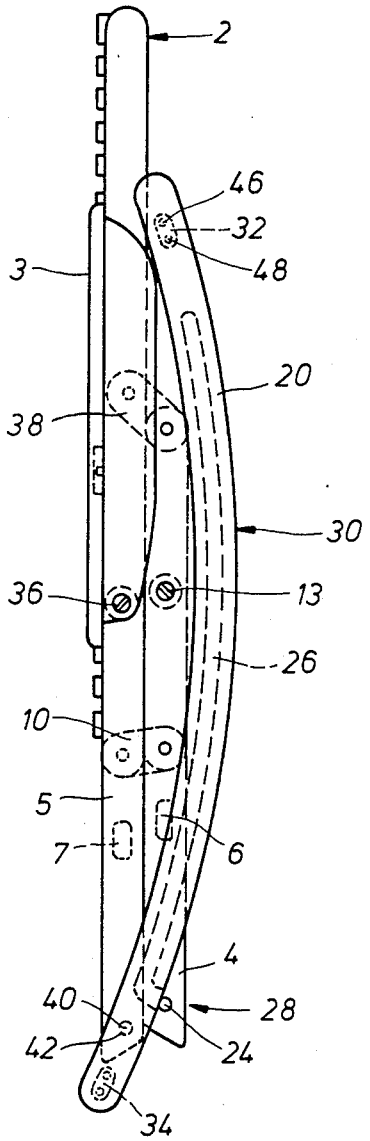

Hereinafter preferred embodiments of the folding furniture will be described with the aid of the drawings, wherein:

FIG. 1 is a side view of a piece of folding furniture according to the invention with attached rockers, FIG. 2 a perspective illustration of the rockers, FIG. 3 is a side representation of the folding furniture with attached rockers in the folded-up state, FIGS. 4*a* and 4*b* are partial sections of preferred embodiments of the connecting and guide elements.

FIG. 1 shows in side view as folding furniture a folding armchair as described in German patent application No. P 36 07 619 or German patent application No. P 36 07 581 which has rockers or runners according to the invention attached at the lower ends of the legs. The folding chair consists as usual of a seat 1, backrest 2, armrests 3, front legs 4, rear legs 5 and a cross strut 6 provided between the front legs 4 and a cross strut 7 arranged between the rear legs 5. The seat 1 is adjustable in its inclination in that in the region of a connecting means 10 preferably arranged in each case laterally between the seat 1 and the backrest 2 a guide and detent mechanism 12 is provided which makes it possible to set various angles of inclination of the seat 1, which is pivotal about an axis of rotation indicated by 13. For example, from the connecting means 10 a lateral pin 15 projects into a guide groove 16 with various detent grooves 17*a*, 17*b* and by moving the pin 15 into the different detent grooves effects a change in the inclination of the seat 1. This is described in detail in patent application No. P 36 07 619. Furthermore, the armrest 3 can also be adjustable for adjusting the inclination of the backrest 2 as likewise explained in patent application No. P 36 07 619. For storage such a folding chair can be folded up into a very compact form.

By attaching rockers 20 to the lower portions of its legs 4, 5 the folding armchair described with reference to FIG. 1 can be converted to a rocking chair. The runners or rockers 20 have an essentially arcuate form and at their end portions denoted by 22a, 22*b* are preferably made rectilinear as regards the downwardly directed support face, as a consequence of which when the rocking chair is being used tipping beyond these straight support faces at 22*a*, 22*b* is prevented. Between the regions 22*a*, 22*b* the support face of each rocker 20 is made arcuate or elliptical.

In the embodiment illustrated in conjunction with FIGS. 1 to 3 the rockers 20 are each attached laterally from the outside to the lower ends of the legs 4, 5. With the connecting elements still to be described the two rockers 20 can be easily and rapidly attached to and removed from the legs 4, 5. In the embodiment illustrated the ends of the rear legs 5 are mounted rotatably at the end region of each rocker 20 whilst the lower ends of the front legs 4 are adjustable with respect to the rocker 20. For this purpose, provided at the lower end of the two front legs 4 is a guide element 24 which projects from the legs 4 laterally into a guide groove 26 which extends over a major part of the length of the rocker 20 in the inner face of each rocker 20. According to a modification the rockers 20 may be attached to the inner faces of the legs 4, 5; in this case each guide groove 26 is on the outwardly directed face of each rocker 20 and the guide element 24 in this case projects from the inner face of each front leg 4 laterally inwardly.

The guide groove 26 has an arcuate form which corresponds to the movement travel of the guide element 24 which it executes when the folding chair is folded up due to the movement of the two leg pairs 4, 5 towards each other into the position shown in FIG. 3 with respect to the rear leg 5. The guide groove 26 extends towards the region 22*a* to such an extent that when the rocker 20 is fitted any adjustment of the folding chair is possible along with adjustment of the seat 1, which possibly results in a spreading apart of the associated leg pairs 4, 5 with respect to each other.

If as in the folding chair illustrated in FIG. 1 the rear leg pair 5 is connected rotatably to the rocker 20 each guide groove 26 comprises a substantially slit-shaped opening 28 towards the support edge of each rocker 20 denoted in FIG. 1 by 30. This slit-like opening 28 preferably has a conically widening form from the guide groove 26 towards the support face 30. The slit-shaped opening 28 lies in the plane of the groove 26 and at the end of the groove 26 extends laterally away from the latter.

To stabilize the rockers 20 in accordance with FIG. 2 cross struts 32, 34 may be inserted between the rocker pairs in FIG. 2 being denoted by 20' and 20''.

The folding chair is folded up in that said chair is moved out of the position shown in FIG. 1 by pivoting the seat 1 towards the backrest 2. Since the seat 1 in the embodiment shown is rotatably mounted in the region of the rotation axis 13 on the front legs 4 and at the same time the armrest 3 in the embodiment shown is rotatably mounted laterally on the backrest 2 at 36, the respective front legs and rear legs 4, 5 being connected to each other by a connecting member 38, which is only indicated, folding of the seat 1 towards the backrest 2 or vice versa results in the pair of front legs 4 and the pair of rear legs 5 being brought into a position substantially parallel to each other into engagement with each other so that the state shown in FIG. 3 is reached. The guide elements 24 attached to the lower ends of the front legs 4 move rearwardly within the guide groove 26, i.e. in the direction towards the opening 28, and reach the position indicated in FIG. 1 in dashed line and denoted by the reference numeral 24' within the slit 28 just before achieving the parallel position of the front and rear leg pairs according to FIG. 3. The folding together of the chair also causes the rocker pair to execute a pivot movement with respect to a rotational axis 40 of the rear legs 5 so that the angle between the rear leg pair 5 and the rocker pair 20 becomes increasingly smaller and the rockers 20 move about the axis of rotation 40 into the position illustrated in FIG. 3 before the guide pin 24 moves out of the opening 28 due to the complete folding together and the movement of the legs 5, 6 into the parallel position shown in FIG. 3. The rockers 20 in this manner come to lie almost in the plane of the front and rear leg pairs 4, 5 and in the preferred folding chair illustrated in FIGS. 1 and 3 in their front region are in engagement with the lower face of the armrest 3. As a result, in the collapsed state an extremely compact form is ensured, including the articulately attached or linked rockers, thus providing compact storing of the folded chair or rocking chair.

In the embodiment described above the lower ends of the rear legs 5 are connected in the region of the axis of rotation denoted by 40 rotatably and fixedly to the rockers 20 by connecting elements 42 whilst the front legs 4 are adjustably guided in the longitudinal direction of the rockers 20. Fundamentally, the arrangement may also be the converse, i.e. the rockers 20 may be rotatably mounted at the lower ends of the front legs 4 whilst the lower ends of the rear legs 5 are displaceably guided along the rockers. In this example of embodiment the rockers bear on the support face of the armrests 3. However, the embodiment described in FIG. 3 in conjunction with FIG. 1 is preferred because in this example of embodiment in the collapsed state an extremely compact form can be obtained.

As apparent from FIGS. 1 and 2, the front cross strut 32 may be provided at various distances from the front end of the rocker pair, as indicated by the reference numeral 32'. Thus, the cross strut 32 may be provided for example at the point 32, i.e. far to the front end of the rocker pair 20 if this cross strut is to serve as footrest or support the feet. If the cross strut 32 is not to serve as footrest and the front region between the footrests is to be as free as possible from such a strut to avoid meeting the feet of the chair user, the cross strut is inserted at a position which is as close as possible to the end of the front legs 4 and is indicated by 32'. Each cross strut 32, 34 comprises for example studs 46, 48 which are adapted to be inserted into associated bores at the inner face of the rockers 20. Preferably, screws are additionally employed to connect the cross struts 32, 34 firmly to the rockers 20. Obviously, other types of securing may also be used for the fixed arrangement of the struts 32, 34 between the rockers 20. In FIG. 2 the bores in the rockers 20 corresponding to reference numeral 32 in FIG. 1 are denoted by 50 and the bores in the rockers 20 corresponding to the reference numeral 32' are denoted by 52.

Hereinafter preferred embodiments of the bearing and guide means will be described by means of which the lower leg ends of the folding chair are fixed with respect to the rockers 20. FIG. **4*a*** shows a sectional view along the line IV*a*—IV*a* in FIG. 1 for a preferred embodiment of the rotatable fixed mounting of the lower ends of the rear legs 5 with respect to the rockers 20.

As apparent from FIG. **4*a* the rear leg 5 is located with respect to the rocker 20 at the inwardly directed face thereof. The lower end of each rear leg 5 is held by a connecting element 54, for example in the form of a screw or knurled screw, rotatably with respect to the rocker 20, for which purpose said rocker 20 comprises a bush 56 with inner thread into which the screw 54 is screwed with its threaded region. The region of the connecting element 54 traversing the rear leg 5 preferably does not have an outer thread and is provided at its end remote from the rocker 20 with a head or knurled head 57 which supports the leg 5 pivotally with respect to the rocker 20 as soon as the screw 54 is screwed into the threaded bush 56. In the region of the screw connection 54 and between the head 57 and the inner leg 5** a metal washer is possibly provided to reduce the frictional forces.

According to FIG. **4*b* the end of each front leg 4 is slidingly mounted by a connecting or guide element 24 in the guide groove 26. In the embodiment shown in FIG. 4*b* as connecting or guide element 24 a threaded bolt is provided, the head 61 of which has a smaller diameter than the width of the guide groove 26 and which is provided at its end remote from the head 61 with an outer thread. The bolt 24 is led through a bore at the lower end of the respective front leg 4 and is secured with respect to the lower leg for example by a nut or knurled head 60 which is screwed onto the head of the bolt. In the embodiment described the guide element 24 can thus be inserted by way of its head denoted by 61 slidingly into the guide groove 26 and on movement of the legs or leg pairs 4, 5 towards each other is displaceable within the guide groove 26. On a movement of the guide element 24 with respect to the guide groove 26 said guide element 24 can execute with its head 61 possibly a sliding or rolling movement with respect to the opposing upper and lower groove walls 26*a*, 26*b* of the guide groove 26, the head 61 preferably being made cylindrical for this purpose. It is apparent that the head 61 is mounted movably in the guide groove 26 so that it can be moved laterally out of the latter. The substantially U-shaped guide groove 26 does not prevent the guide element 24** from executing a movement in the direction of the arrow A.

If it is desired to mount the head 61 in the guide groove 26 so that a lateral movement out of said guide groove 26 in the direction of the arrow A is prevented, said guide groove 26 can for example have a dovetail profile so that the lower side of the head 61 bears slidingly on the dovetail guide and lateral displacement of the guide element 24 out of the guide groove 26 is prevented. In the latter case, at a predetermined position of the guide groove a bore corresponding to the diameter of the head 61 is provided to permit insertion and removal of the guide element 24.

The invention thus provides a folding chair which by attaching rockers can be converted to a rocking chair and nevertheless still permits any adjustment facilities provided such as changing the inclination of the backrest and/or the seat. By the formation of the guide grooves according to the invention in the two rockers folding together of the folding chair when the rockers are attached is possible to give an extremely compact form, the path of the guide groove being chosen such that at a predetermined position an outwardly extending preferably conically widening slit is provided which for the purpose of complete collapsing into the form shown in FIG. 3 allows the guide element 24 to come out of the groove 26 and thus ensures that the end of each rocker remote from the axis 40 of rotation in FIG. 3 comes into close engagement with the front edge of the corresponding armrest 3, ensuring the compact form of the folding chair in the collapsed state.

It is apparent from the above description that a folding chair in order to use the rocking runners in the region of its legs 4, 5 need only be provided with transverse bores serving for passage of the connecting elements 24, 54 whilst the rockers are provided at a predetermined point with a bore which serves to secure the connecting elements 54 and into which a threaded bush 56, having for example an inner and outer thread, can be screwed. The guide element denoted in FIG. 4*b* by 24 is designed such that the frictional resistance between the guide element 24 and guide groove 26 is minimized and thus easy folding up of the folding chair obtained with simultaneous movement of the lower end of the front legs 4 along the guide groove 26 in the direction towards the rear leg pair 5.

The right side of the folding chair has been described with regard to FIGS. 1 and 3. It is obvious that the left side has a construction which is symmetrical with respect to the chair centre.

I claim:

1. A collapsible rocking chair of the type having a back rest, a seat, front legs and rear legs, connected to assume folded and unfolded use positions, comprising:

first and second rockers pivotally mounted to selected ones of said front and rear legs, each rocker having a length;

a guide element, situated at a lower end of each of the others of the front and rear legs;

a guide groove, including an insertion slot situated at an end of said guide groove, extending over a substantial length of each rocker and adapted to receive said guide element through said insertion slot and into said guide groove for movement therealong as the seat assembly is manipulated between the folded and unfolded use positions; and means for adjustably connecting said seat, backrest and rear legs, adapted to permit said seat to be adjusted in inclination in an unfolded use position, and collapsed for storage in a folded position;

said guide element being removable from said guide groove through said insertion slot, permitting said chair to be collapsed in a folded position for storage with said seat lying against said back rest.

2. A collapsible rocking chair according to claim 1, wherein the guide groove is arcuate.

3. The collapsible rocking chair of claim 1 wherein the guide groove is arcuate.

4. A collapsible rocking chair according to claim 1, wherein said insertion slot is situated in a plane of said guide groove and extends away from said guide groove.

5. A collapsible rocking chair according to claim 1, wherein said insertion slot is conically shaped, and widens from said guide groove outward toward a horizontal surface on said rocker member.

6. A collapsible rocking chair according to claim 1, further including a cross strut connecting the first and second rockers to each other.

7. A collapsible rocking chair according to claim 6, wherein a cross strut is adjustably mounted on a longitudinal axis of each rocker.

* * * * *